US009611118B2

(12) United States Patent
Ito

(10) Patent No.: US 9,611,118 B2
(45) **Date of Patent: *Apr. 4, 2017**

(54) MEDIUM EJECTION APPARATUS AND IMAGE FORMING APPARATUS

(71) Applicant: Brother Kogyo Kabushiki Kaisha, Nagoya-shi, Aichi-ken (JP)

(72) Inventor: Yoshiyuki Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/080,007

(22) Filed: Nov. 14, 2013

(65) Prior Publication Data

US 2014/0070485 A1 Mar. 13, 2014

Related U.S. Application Data

(63) Continuation of application No. 12/392,356, filed on Feb. 25, 2009, now Pat. No. 8,594,556.

(30) Foreign Application Priority Data

Feb. 26, 2008 (JP) ..... 2008-044629

(51) Int. Cl.

| | |
|---|---|
| ***B65H 31/26*** | (2006.01) |
| ***B65H 29/14*** | (2006.01) |
| ***B65H 29/52*** | (2006.01) |
| ***G03G 15/00*** | (2006.01) |

(52) U.S. Cl.

CPC ..... *B65H 29/14* (2013.01); *B65H 29/52* (2013.01); *B65H 31/26* (2013.01);

(Continued)

(58) Field of Classification Search

CPC ..... G03G 15/6552; B65H 29/14; B65H 2404/1341; B65H 2404/144; B65H 2404/7414; B65H 2601/26

See application file for complete search history.

(56) References Cited

U.S. PATENT DOCUMENTS 4,789,150 A 12/1988 Plain
5,094,660 A * 3/1992 Okuzawa ..... B65H 29/70 271/178

(Continued)

FOREIGN PATENT DOCUMENTS

JP S54-56382 U 4/1979
JP 563-37069 A 2/1988

(Continued)

OTHER PUBLICATIONS

"Plastic Hardness Guide", Pactumax International, www.pactumax.com.*

(Continued)

*Primary Examiner* — Justin Olamit
(74) *Attorney, Agent, or Firm* — Banner & Witcoff, Ltd.

(57) ABSTRACT

A medium ejection apparatus is provided which may be part of an image forming apparatus. The medium ejection apparatus may include an ejection roller configured to eject a recording medium and a pinch roller disposed opposite to the ejection roller. The pinch roller is configured to move toward and away from the ejection roller and to press a recording medium toward the ejection roller. Also, the medium ejection apparatus may include an elastic member configured to press the pinch roller toward the ejection roller and a lever disposed downstream of the pinch roller in a recording medium transport direction. The lever is configured to be moved between a first position and a second position. When the lever is in the second position, the lever contacts the pinch roller, which causes a force to be applied against the elastic member, and the pinch roller is spaced away from the ejection roller.

14 Claims, 7 Drawing Sheets

(52) U.S. Cl.
CPC . *G03G 15/6552* (2013.01); *B65H 2404/1341* (2013.01); *B65H 2404/144* (2013.01); *B65H 2404/7414* (2013.01); *B65H 2601/26* (2013.01); *B65H 2801/06* (2013.01)

(56) References Cited

U.S. PATENT DOCUMENTS

| | | | | |
|---|---|---|---|---|
| 5,249,793 | A * | 10/1993 | Scheufler | 271/220 |
| 6,089,567 | A | 7/2000 | Yatsuhashi et al. | |
| 6,109,130 | A | 8/2000 | Will | |
| 6,950,619 | B2 | 9/2005 | Sunohara | |
| 2005/0220520 | A1 | 10/2005 | Kawamoto | |
| 2007/0177916 | A1 | 8/2007 | Ninomiya | |

FOREIGN PATENT DOCUMENTS

| | | | |
|---|---|---|---|
| JP | H01-267252 | A | 10/1989 |
| JP | H09-77339 | A | 3/1997 |
| JP | H09-77388 | A | 3/1997 |
| JP | 2004-091178 | A | 3/2004 |
| JP | 2005-247442 | A | 9/2005 |
| JP | 2007-204228 | A | 8/2007 |

OTHER PUBLICATIONS

"Mylar/Melinex PET Washers", Performance Puched Parts, Penn Fibre, www.performancepuchedparts.com.*
JP Office Action dtd May 25, 2010, JP Appln. 2008-044629, English translation.

* cited by examiner

MEDIUM EJECTION APPARATUS AND IMAGE FORMING APPARATUS

CROSS REFERENCE TO RELATED APPLICATION

This application is a continuation of prior U.S. application Ser. No. 12/392,356, filed Feb. 25, 2009, which claims priority from Japanese Patent Application No. 2008-044629, filed on Feb. 26, 2008, the entire subject matter of which is incorporated herein by reference.

FIELD

Aspects of the invention relate to a medium ejection apparatus and an image forming apparatus having the medium ejection apparatus.

BACKGROUND

A known image forming apparatus may include a lever in proximity to an ejection roller to ensure that each recording medium, e.g., a sheet of paper, on which an image has been formed, is stacked on an output tray. An upper end of the lever is attached to a main body of the image forming apparatus so that the lever is movable. The lever is configured to move downward under its gravity and to press a recording sheet having an image thereon ejected from the image forming apparatus downward or toward the output tray.

As the lever is attached to the main body of the image forming apparatus in proximity to the ejection roller, it may be accidentally pressed down when a user takes a recording sheet placed on the output tray. Alternatively, when the user takes a stack of recording sheets from the output tray and then puts the stack back on the tray, the stack may hit the lever. The lever is susceptible to such a great force produced by a user or by contact with an object, and may separate from the main body of the image forming apparatus.

SUMMARY

Illustrative aspects of the invention provide a medium ejection apparatus and an image forming apparatus including such a medium ejection apparatus configured to prevent a lever from separating from a main body of the image forming apparatus when the lever is subjected to a great force.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. An image forming apparatus 1 according to aspects of the invention applies to a monochrome laser printer.

Figure 1:
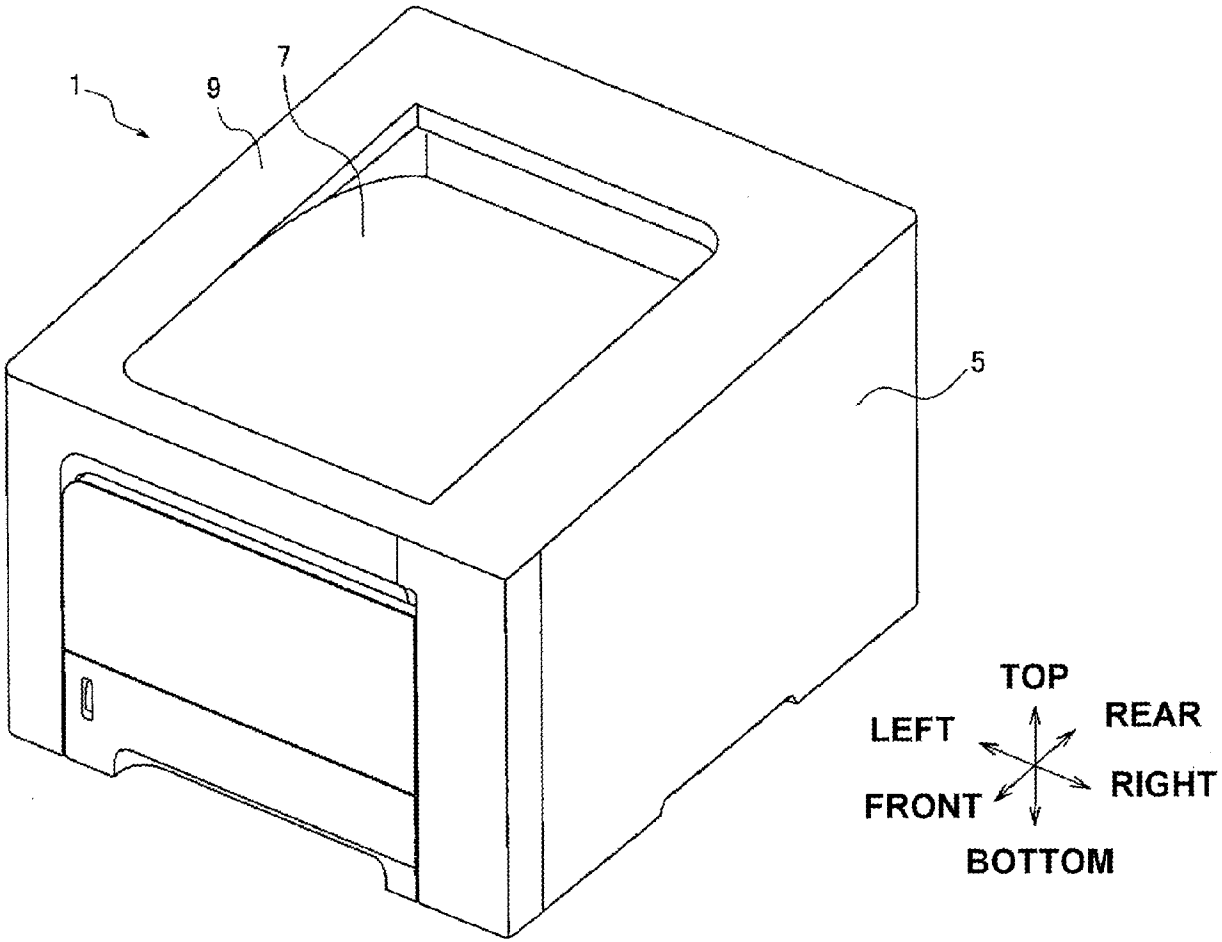
FIG. 1 is a perspective view of an outer appearance of an illustrative example of an image forming apparatus using features described herein.

For ease of discussion, in the following description, the top or upper side, the bottom or lower side, the left or left side, the right or right side, the front or front side, and the rear or rear side are used to define the various parts when the image forming apparatus 1 is disposed in an orientation in which it is intended to be used, as shown in FIG. 1.

Figure 2:
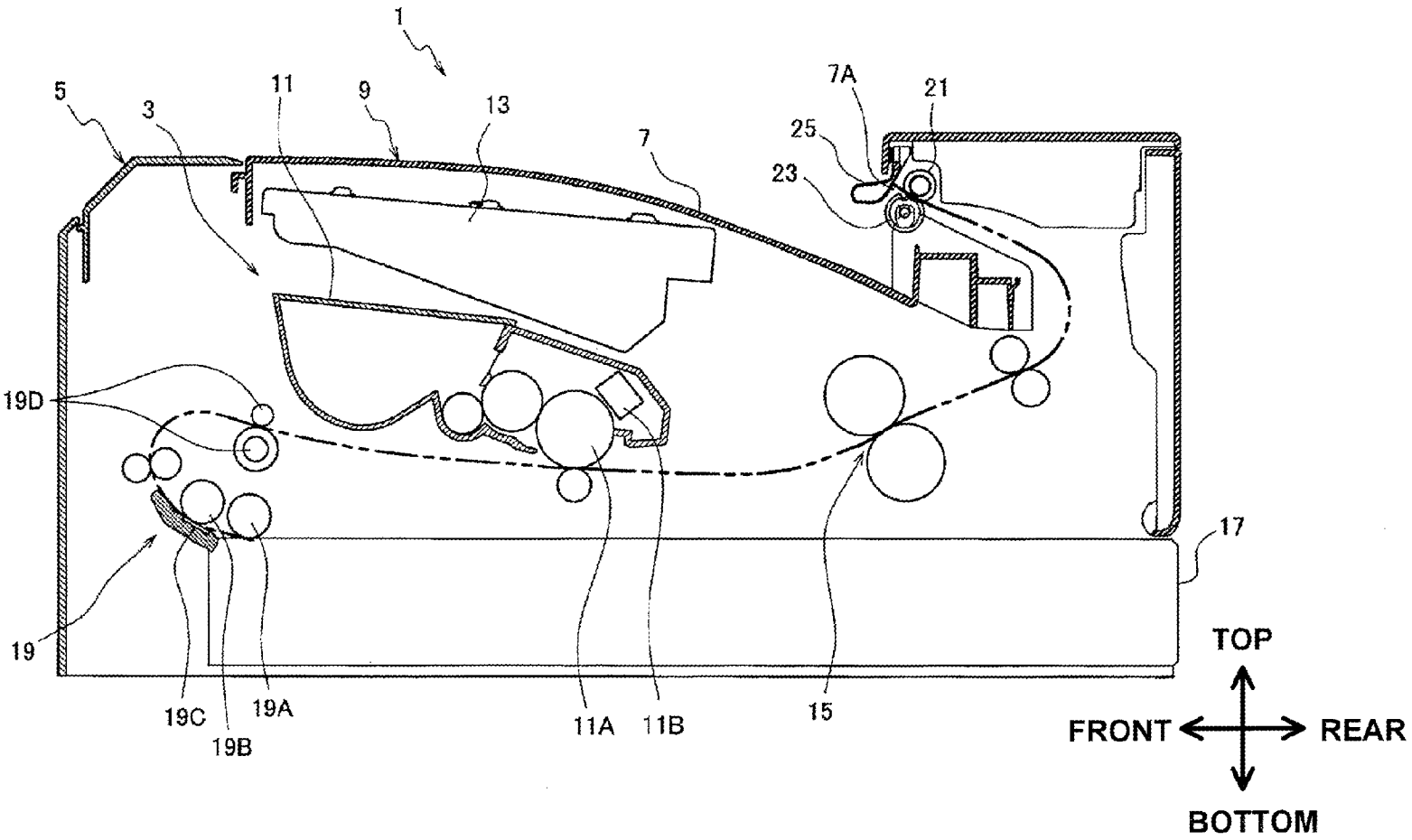
FIG. 2 is a sectional view of the image forming apparatus of FIG. 1.

As shown in FIG. 1, the image forming apparatus 1 may include a generally box-shaped main body 5. A top surface of the main body 5 is a top cover 9 which includes an output tray 7. The image forming apparatus 1 may further include an electrophotographic image forming unit 3 (FIG. 2) that is configured to form an image on a recording medium, e.g., a sheet of plain paper and a transparency, (hereinafter referred to as a recording sheet) by transferring a developer image onto the recording sheet. A recording sheet on which an image has been formed at the image forming unit 3 is ejected and placed onto the output tray 7.

In this illustrative embodiment, the top cover 9 is detachably attached to the main body 5. The main body 5 and the top cover 9 can be made of resin such as acrylonitrile butadiene styrene (ABS).

The image forming unit 3 is accommodated in the main body 5 and includes, as is well known, a process cartridge 11, a light exposing device 13, and a fixing unit 15.

A sheet supply tray 17 may be disposed in a lower portion of the main body 5 and be configured to have a stack of sheets loaded therein. A feeder unit 19 is disposed at the front side of the sheet supply tray 17. The feeder unit 19 includes a pick up roller 19A, a separation roller 19B, a separation pad 19C, and a pair of registration rollers 19D. A recording sheet is separated from the stack of recording sheets by the pickup roller 19A, the separation roller 19B, and the separation pad 19C, and fed between the registration rollers 19D to correct skew of the recording sheet, and is further fed to the process cartridge 11.

A developer image is transferred onto the recording sheet at the process cartridge 11, and heated and fixed at the fixing unit 15. The recording sheet, which is fed from the fixing unit 15, changes its feeding direction upward about 180 degrees, and is ejected from an ejection portion 7A, which opens to the output tray 7.

The process cartridge 11 includes a photosensitive drum 11A on which the developer image is carried, and a charger 11B configured to charge the photosensitive drum 11A. The photosensitive drum 11A is charged by the charger 11B, and exposed to light by the light exposing device 13, so that an electrostatic latent image can be formed on an outer surface of the photosensitive drum 11A. When the photosensitive drum 11A is supplied with developer, a developer image can be carried or formed on the outer surface of the photosensitive drum 11A.

As shown in FIGS. 2-5, ejection rollers 21, pinch rollers 23, and levers 25 are arranged in the ejection portion 7A of the output tray 7.

The ejection rollers 21 are configured to rotate in contact with a recording sheet received from the image forming unit 3 and to eject the recording sheet to the output tray 7. At least cylindrical portions of the ejection rollers 21 that contact the recording sheet are formed of an elastic material such as rubber.

Figure 6A:
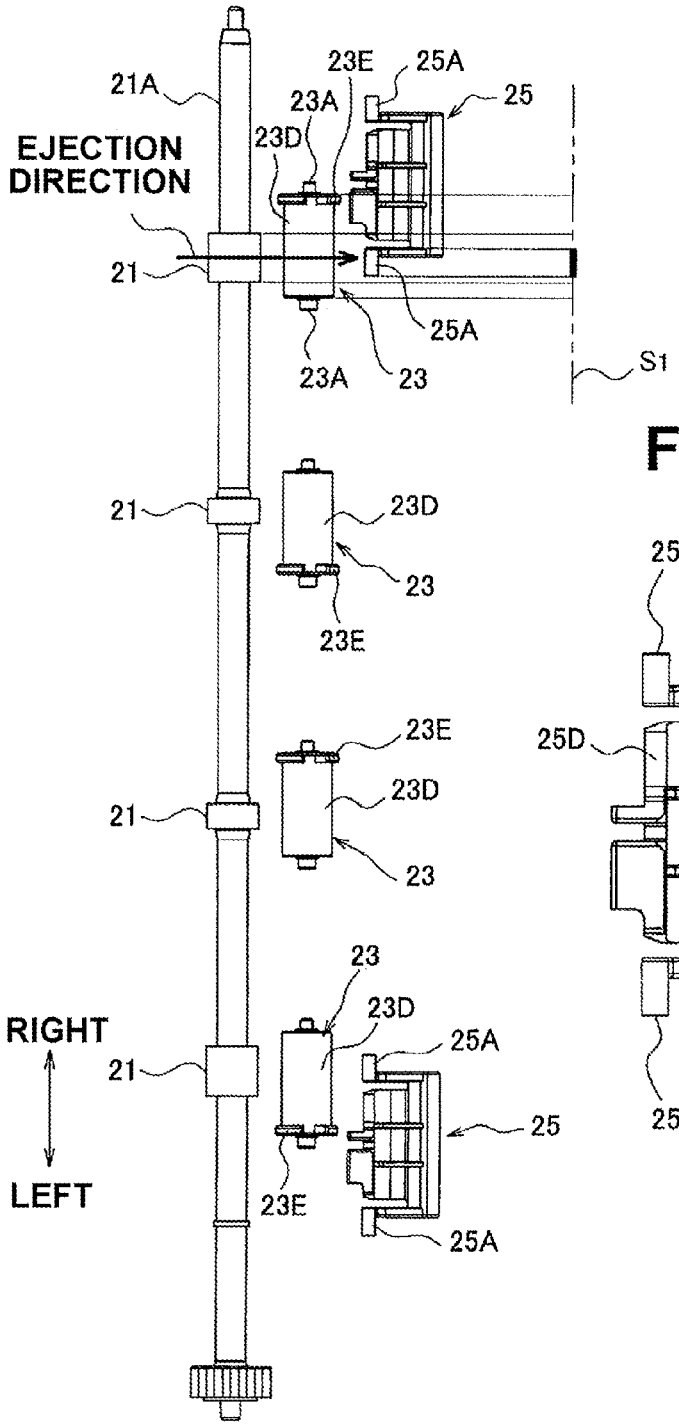
FIG. 6A is an exploded top view of FIG. 5.

As shown in FIG. 6A, a plurality of, e.g., four in this illustrative embodiment, ejection rollers 21 is disposed with each roller 21 in spaced relation to each other around a drive shaft 21A extending in a widthwise direction of the ejection portion 7A, i.e. in a right-left direction of the image forming apparatus 1. The ejection rollers 21 are driven by the drive shaft 21A that is rotatably attached to the top cover 9.

Figure 7A:
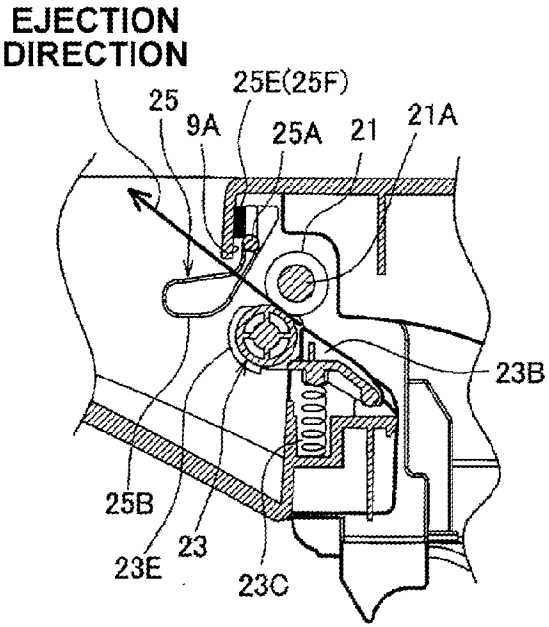
FIGS. 7A, 7B, and 7C are sectional views taken along line A-A of FIG. 5, showing a series of operations of the lever responsive to an external force.

The pinch roller 23 is disposed facing a corresponding ejection roller 21 from below as shown in FIG. 7A. The pinch rollers 23 are cylindrically shaped as shown in FIG. 6A, and are configured to press the recording sheet toward the ejection rollers 21. The pinch rollers 23 are movably attached to the top cover 9 such that they move toward and away from the corresponding ejection rollers 21.

Figure 7B:
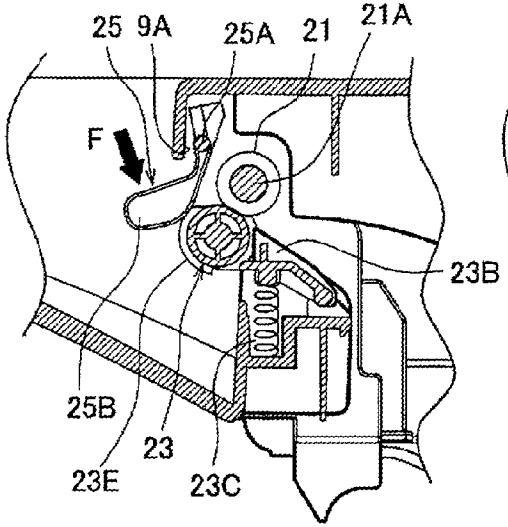
Figure 7C:
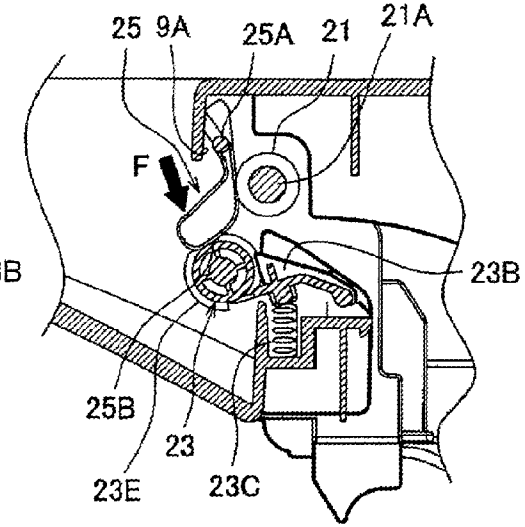

Each pinch roller 23 is provided with support shaft portions 23A (FIG. 6A), which are rotatably engaged in recessed portions in a pinch holder 23B (FIGS. 7A-7C).

The pinch holder 23B is movably attached to the top cover 9 at an upstream side of a corresponding pinch roller 23 in a sheet ejection direction. The pinch holder 23B is pressed toward the ejection roller 21 by an elastically deformable pressing member, e.g. a coiled spring 23C. Thus, each pinch roller 23 can move toward or away from a corresponding ejection roller 21 and be normally pressed toward the corresponding ejection roller 21 by the coiled spring 23C.

As shown in FIG. 6A, each pinch roller 23 further includes a cylindrical roller portion 23D, and a flanged portion 23E protruding outwardly from the entire perimeter of the roller portion 23D. The roller portion 23D and the flange portion 23E are integrally formed of a resin material having a higher hardness than that for the ejection rollers 21, for example, polyoxymethylene (POM).

Figure 3:
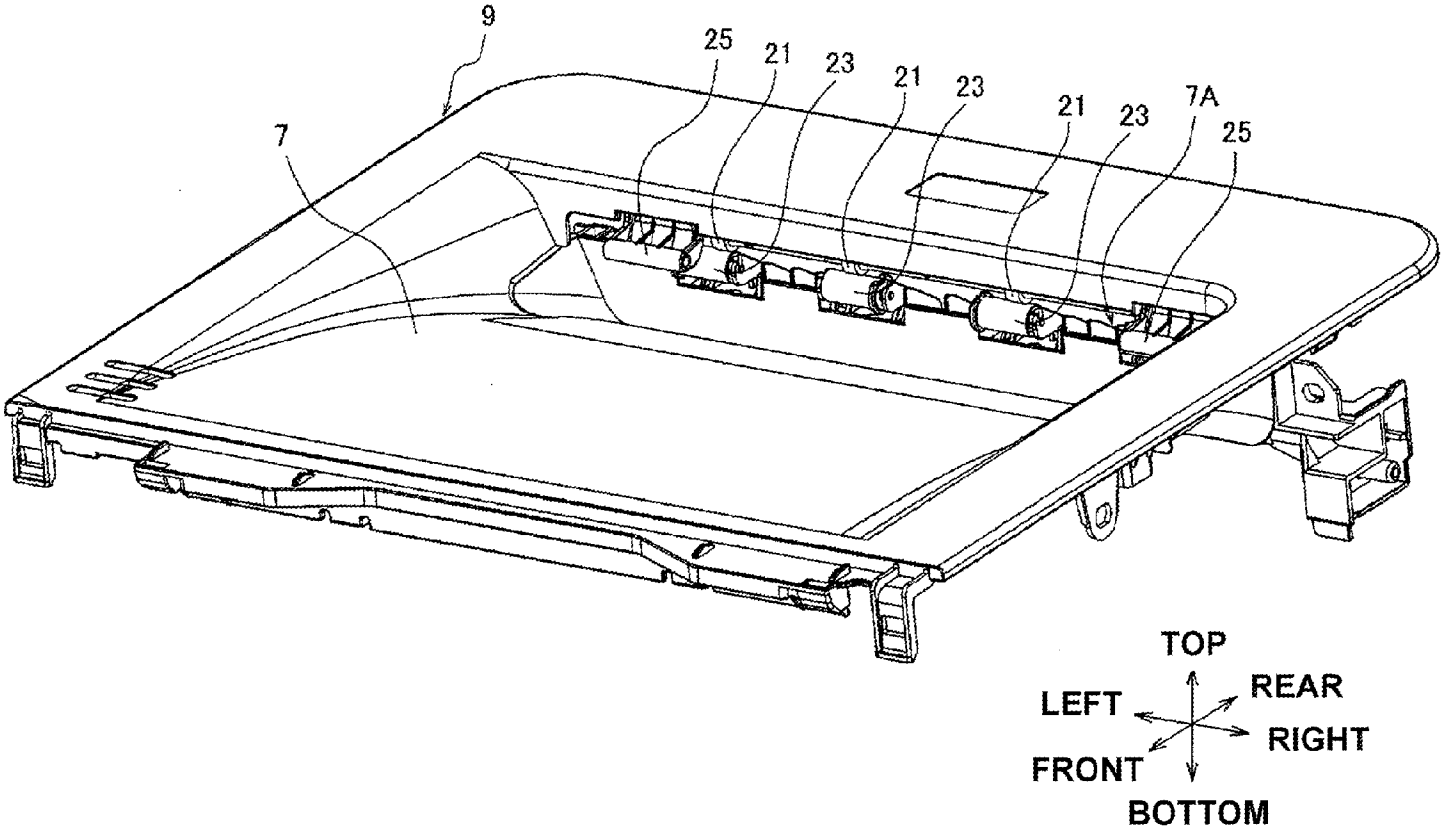
FIG. 3 is a perspective view of a top cover.
Figure 4:
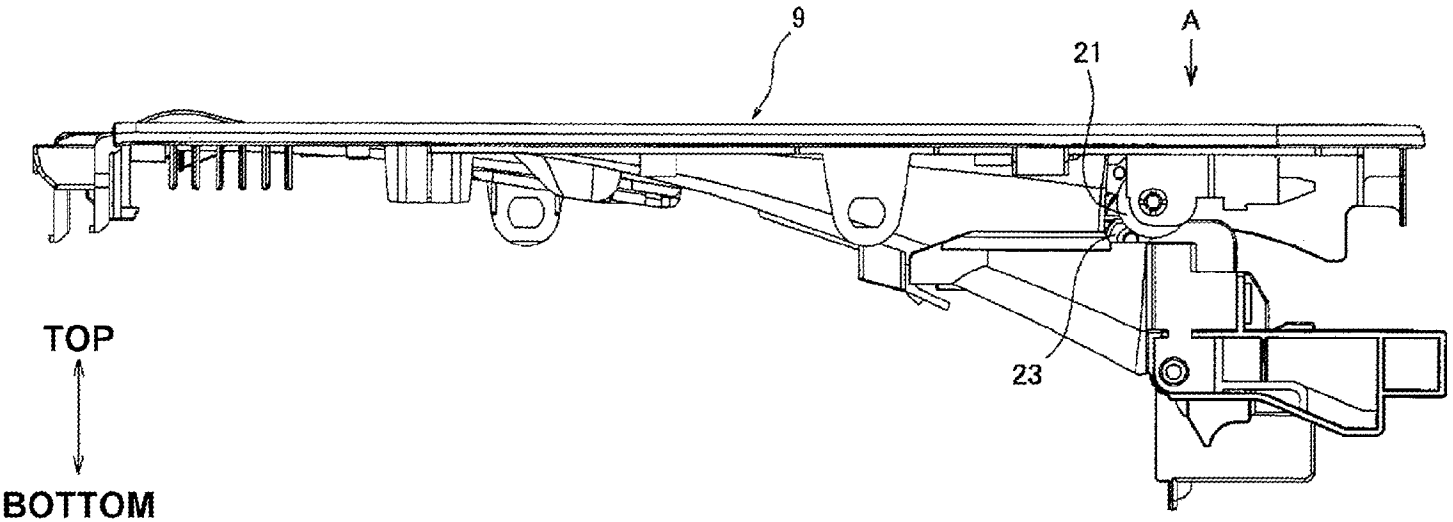
FIG. 4 is a side view of the top cover.
Figure 5:
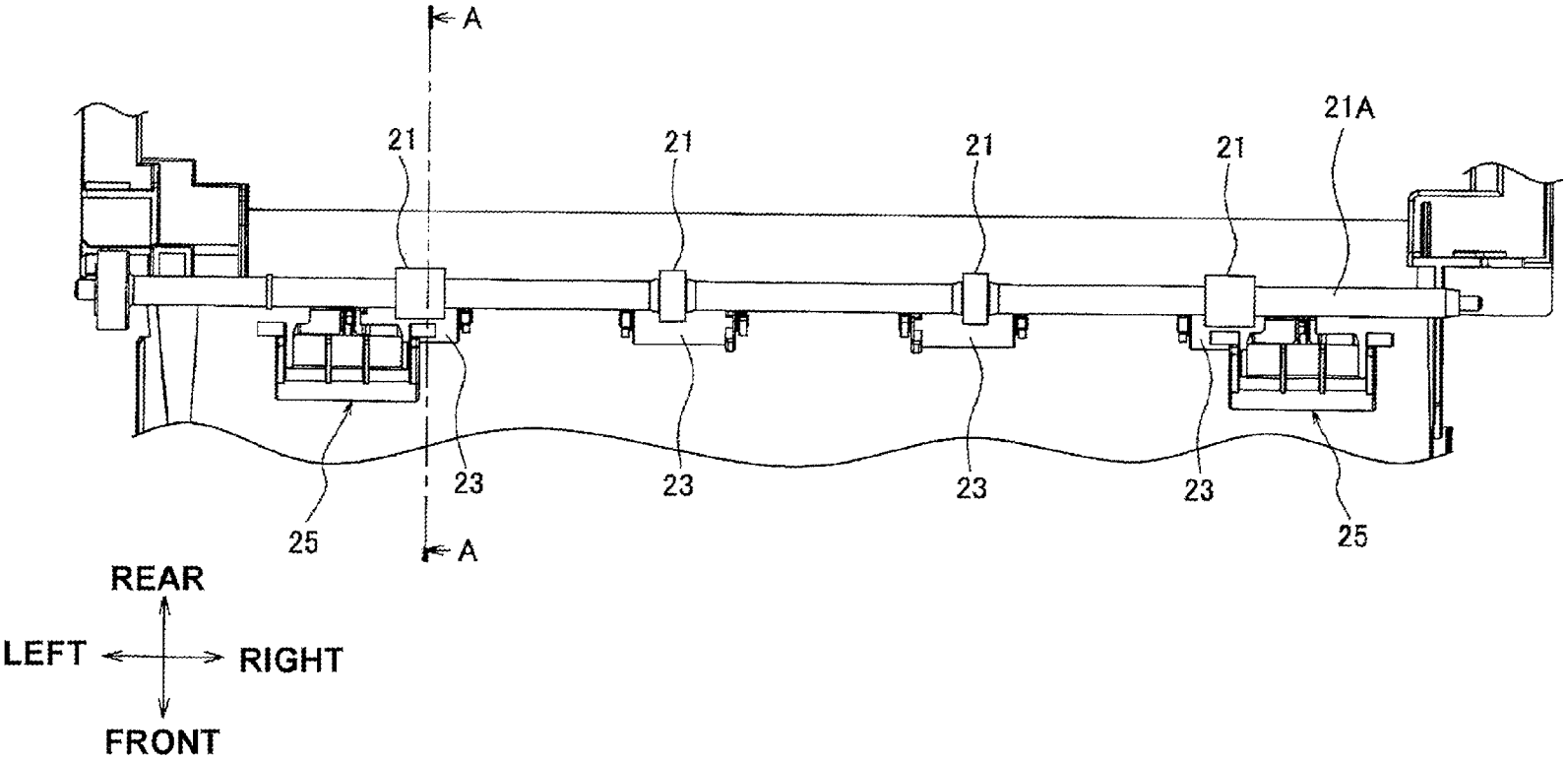
FIG. 5 is a top view showing a positional relationship between ejection rollers, pinch rollers, and levers when viewed from an arrow A of FIG. 4.
Figure 6B:
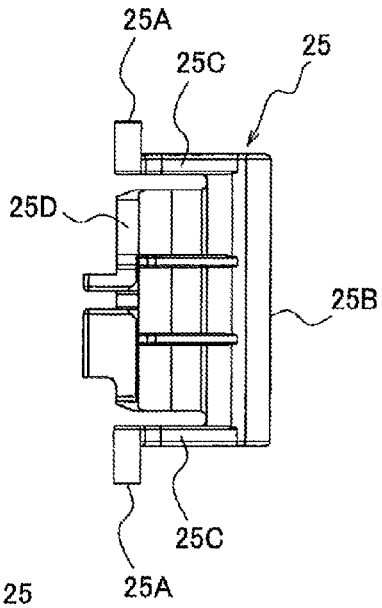
FIG. 6B is a top view of the lever.

As shown in FIG. 3, the levers 25 extend toward the output tray 7 from the ejection portion 7A. The levers 25 are formed of a resin material similar to the pinch roller 23 and are configured to press a recording sheet being ejected by the ejection rollers 21 downward. As shown in FIG. 6B, each lever 25 includes shaft portions 25A, a weight portion 25B, and arm portions 25C. As shown in FIG. 7A, the shaft portion 25A is disposed in an upper end of the lever 25, and the shaft portion 25A is attached to the top cover 9 so that the lever 25 is movable.

As shown in FIG. 6B, the weight portion 25B extends in a direction parallel to an axial direction of the ejection rollers 21 (hereinafter referred to as a width direction), and is configured to contact the recording sheet being ejected by the ejection rollers 21 and press it downward. The arm portions 25C extend from both ends of the weight portion 25B toward the shaft portions 25A.

The shaft portions 25A protrude toward the top cover 9, and rotatably engage in recessed portions (not shown) of the top cover 9, so as to movably support the lever 25. When the lever 25 is attached to the top cover 9, the arm portions 25C are elastically deformed so that they move toward each other, and the shaft portions 25A are inserted into the recessed portions of the top cover 9.

The lever 25 further includes a tongue portion 25D between the arm portions 25C. The tongue portion 25D is provided with a contact portion 25E at an end. As shown in FIG. 7A, the contact portion 25E contacts a contacted portion 9A of the top cover 9 when there is no external force applied to the lever 25.

The lever 25 would rotate so that the weight portion 25B moves toward the pinch roller 23 under its weight. However, when external force is not applied to the lever 25, the contact portion 25E contacts the contacted portion 9A, and the lever 25 is prevented from contacting the pinch roller 23. In this illustrative embodiment, the contact portion 25E and the contacted portion 9A restrict the movement of the lever 25 such that the lever 25 is prevented from making contact with the pinch roller 23.

The contact portion 25E includes an elastic member 25F in an area where the contact portion 25E contacts the contacted portion 9A. The elastic member 25F is formed of an elastically deformable material such as rubber. The elastic member 25F is configured to absorb noise produced when the contact portion 25E contacts or hits the contacted area 9A.

As shown in FIG. 7B, when the lever 25 receives external force and is moved downward, it contacts the flange portion 23E of the pinch roller 23 ahead of the ejection roller 21.

As shown in FIG. 6A, the levers 25 are disposed at positions corresponding to two ejection rollers 21 positioned outermost of the four ejection rollers 21 attached around the drive shaft 21A. Positions and dimensions of the ejection rollers 21, the pinch rollers 23 and the levers 25 are set to obtain the following positional relationship:

In FIG. 6A, S1 represents an imaginary plane that is orthogonal to a sheet ejection direction where a recording sheet is ejected by the ejection rollers 21. When the ejection roller 21, the pinch roller 23 and the shaft portion 25A of the lever 25 are projected to the imaginary plane S1 in the sheet ejection direction, a projected image of the shaft portion 25A overlaps at least one of projected images of the ejection roller 21 and the pinch roller 23 on the imaginary plane S1. In this illustrative embodiment, as shown in FIG. 7A, the projected image of the shaft portion 25A overlaps that of the ejection roller 21 on the imaginary plane S1.

Specifically, as shown in FIG. 6A, the ejection roller 21, the pinch roller 23, and the lever 25 are arranged in line along the sheet ejection direction.

When there is no external force being applied to the lever 25 as shown in FIG. 7A, the pinch roller 23 contacts the ejection roller 21 by a pressing force of the coiled spring 23C, the contact portion 25E contacts the contacted portion 9A, and the lever 25 is spaced away from the pinch roller 23.

In a state where the lever 25 is away from the pinch roller 23, when a recording sheet having the image thereon caught between the ejection roller 21 and the pinch roller 23 is ejected to the output tray 7, the trailing end of the recording sheet is held by the lever 25.

The levers 25 are exposed outside at the output tray 7 because they have a function to hold recording sheets to be ejected to the output tray 7. Thus, there is a high possibility that the user will touch or press the levers 25, causing the levers 25 to be subjected to great downward force.

The output tray 7 receives a recording sheet on which an image has been formed. If the image forming apparatus 1 is employed among a plurality of processors or users and there are recording sheets having images stacked on the output tray 7, a user takes his or her recording sheet(s) from the stack and puts the remaining sheets back on the output tray 7. In this case, the stack of recording sheets may contact the levers 25, and the levers 25 may be subjected to great downward force according to the weight of the stack of recording sheets.

As shown in FIG. 7B, when a downward external force F acts on the lever 25, the lever 25 is moved toward the pinch roller 23, and contacts the flange portion 23E of the pinch roller 23.

When the external force F is great, the lever 25 itself elastically deforms, and contacts the pinch roller 23 and the ejection roller 21 as shown in FIG. 7C.

In this illustrative embodiment, the ejection rollers 21, the pinch rollers 23, and the levers 25 are configured such that, when the lever 25 is moved downward by external force, it contacts the pinch roller 23 ahead of the ejection roller 21 as shown in FIGS. 7A and 7B.

With this configuration, when the external force F acts on the lever 25, the lever 25 contacts the pinch roller 23 and the external force F is absorbed by the elastic deformation of the coiled spring 23C that presses the pinch roller 23. Thus, the lever 25 can be prevented from being separated from the top cover 9, which is part of the main body of the image forming apparatus 1.

In this illustrative embodiment, the pinch rollers 23 and the levers 25 are formed of material having a hardness greater than that of the ejection rollers 21. Thus, the pinch roller 23 can be prevented from getting damaged when the lever 25 contacts the pinch roller 23. In addition, the ejection roller 21, which has a lower hardness, can be prevented from getting damaged because it does not need to structurally absorb the external force acting on the lever 25.

In this illustrative embodiment, when the lever 25 is moved downward by the external force, it contacts the flange portion 23E of the pinch roller 23 without contacting the roller portion 23D. Thus, when the external force F acts on the lever 25, the roller portion 23D can be prevented from getting damaged.

When the external force does not act on the lever 25, the lever 25 does not contact the pinch roller 23. Thus, in normal times when the external force F is not applied, the lever 25 is positioned away from the pinch roller 23.

Thus, noise produced by contact between the pinch roller 23 and the lever 25 can be prevented and the pinch roller 23 can be prevented from getting damaged.

In addition, as the contact portion 25E includes the elastic portion 25F, it can absorb noise produced when the contact portion 25E contacts the contacted portion 9A and the lever 25 can be prevented from getting damaged. The elastic portion 25E may be disposed on the contacted portion 9A.

In this illustrative embodiment, the shaft portion 25A projected to the imaginary plane S1 overlaps the ejection roller 21 projected to the imaginary plane S1 on the imaginary plane S1. Thus, a force acting on the lever 25 or the shaft portion 25A can be received at the ejection roller 21, and the shaft portion 25A can be prevented from being separated from the top cover 9.

Even if the external force F acting on the lever 25 is not excessively great, the lever 25 contacts the pinch roller 23 and the external force F is absorbed by the coil spring 23C as described above. Thus, the lever 25 is not likely to sustain damage. However, if a strong external force is exerted on the lever 25, it can not be fully absorbed only by the coil spring 23C, and the lever 25 may get damaged.

In this illustrative embodiment, however, when the strong external force is applied to the lever 25, the lever 25 contacts the ejection roller 21 and the pinch roller 23, so that the coil spring 23C and the ejection roller 21 absorb the external force. Thus, the lever 25 can be prevented from getting damaged even if the strong external force is applied to the lever 25.

The above illustrative embodiment shows, but is not limited to, a monochrome laser printer. It will be appreciated that this illustrative embodiment also applies to other types of image forming apparatuses, a color laser printer, an inkjet printer, and a facsimile machine as well.

The above illustrative embodiment shows, but is not limited to, the exposing device using laser beams to irradiate the photosensitive drum 11A. An exposing device using a number of LEDs to irradiate the photosensitive drum 11*a* may be applied.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A medium ejection apparatus comprising:

a drive roller configured to eject a recording medium;

a driven roller being disposed at least partially below the drive roller the driven roller being configured to be driven by the drive roller and to press the recording medium toward the drive roller;

a pressing member configured to press the driven roller upwardly toward the drive roller;

a tray configured to receive the recording medium ejected by the drive roller; and a lever disposed, in a recording medium ejection direction, downstream of the driven roller, the lever being configured to guide an end portion of the recording medium ejected by the drive roller to the tray, wherein the lever has a first guide surface located downstream from the rotational axis and a second guide surface located downstream from the first guide surface, the first guide surface and the second guide surface being configured to contact the recording medium ejected by the drive roller to the tray, the first guide surface extending in a first direction, the second guide surface extending in a second direction different from the first direction, the first guide surface and the second guide surface being stationary relative to each other.

2. The medium ejection apparatus according to claim 1, wherein, when the driven roller is in the second position, the pressing member deforms in a direction away from the drive roller.

3. The medium ejection apparatus according to claim 1, wherein the lever has a hardness greater than a hardness of the drive roller.

4. The medium ejection apparatus according to claim 1, wherein the rotational axis of the lever is distinct from a rotational axis of the drive roller.

5. The medium ejection apparatus according to claim 1, wherein, when the driven roller is in the first position, the lever is away from a circumferential surface of the drive roller, and a lower end of the lever is above a portion of the driven roller.

6. The medium ejection apparatus according to claim 1, wherein the lever further includes, as a portion of the second guide surface, a cylindrical portion extending in the specified direction.

7. The medium ejection apparatus according to claim 1, further comprising a second driven roller spaced apart from the driven roller in a specified direction parallel to the drive roller, a third driven roller and a fourth driven roller spaced apart from the third driven roller in the specified direction, the third driven roller and the fourth driven roller being disposed at least partially below the drive roller and between the driven roller and the second driven roller.

8. An image forming apparatus comprising:

an image forming unit configured to form an image on a recording medium;

a drive roller configured to eject the recording medium having the image formed by the image forming unit;

a driven roller being disposed at least partially below the drive roller and configured to press the recording medium toward the drive roller;

a pressing member configured to press the driven roller upwardly toward the drive roller;

a tray configured to receive the recording medium ejected by the drive roller; and a lever disposed, in a recording medium ejection direction, downstream of the driven roller, the lever being configured to guide an end portion of the recording medium ejected by the drive roller to the tray, wherein the driven roller is configured to move from a first position where the driven roller is in contact with the drive roller and the lever to a second position where the first driven roller is in contact with the lever and separated from the drive roller by receiving a pressing force from the lever, wherein the lever is rotatable about a rotational axis extending in a specified direction and located above the driven roller, wherein the lever has a first guide surface located downstream from the rotational axis and a second guide surface located downstream from the first guide surface, the first guide surface and the second guide surface being configured to contact the recording medium ejected by the drive roller to the tray, the first guide surface extending in a first direction, the second guide surface extending in a second direction different from the first direction, the first guide surface and the second guide surface being stationary relative to each other.

9. The image forming apparatus according to claim 8, wherein when the driven roller is in the second position, the pressing member deforms in a direction away from the drive roller.

10. The image forming apparatus according to claim 8, wherein the lever has a hardness greater than a hardness of the drive roller.

11. The image forming apparatus according to claim 8, wherein the rotational axis of the lever is distinct from a rotational axis of the drive roller.

12. The image forming apparatus according to claim 8, wherein, when the driven roller is in the first position, the lever is away from a circumferential surface of the drive roller, and a lower end of the lever is above a portion of the driven roller.

13. The image forming apparatus according to claim 8, wherein the lever further includes, as a portion of the second guide surface, a cylindrical portion extending in the specified direction.

14. The image forming apparatus according to claim 8, further comprising a second driven roller spaced apart from the driven roller in a specified direction parallel to the drive roller, a third driven roller and a fourth driven roller spaced apart from the third driven roller in the specified direction, the third driven roller and the fourth driven roller being disposed at least partially below the drive roller and between the driven roller and the second driven roller.

* * * * *